US006390144B2

(12) United States Patent
Wahhoud et al.

(10) Patent No.: US 6,390,144 B2
(45) Date of Patent: May 21, 2002

(54) TERRY LOOM WITH PILE WARP LENGTH COMPENSATION AND DEFLECTION INTO BACK SHED

(75) Inventors: Adnan Wahhoud, Lindau; Peter Czura, Wangen; Herbert Mueller, Kressbronn; Fritz Rupflin; Thomas Laukamp, both of Lindau, all of (DE)

(73) Assignee: Lindauer Dornier Gesellschaft GmbH, Lindau (DE)

( * ) Notice: Subject to any disclaimer, the term of this patent is extended or adjusted under 35 U.S.C. 154(b) by 0 days.

(21) Appl. No.: 09/855,187

(22) Filed: May 14, 2001

(30) Foreign Application Priority Data

May 12, 2000 (DE) ..... 100 23 444
Nov. 4, 2000 (DE) ..... 100 54 851

(51) Int. Cl.[7] ..... D03D 39/22
(52) U.S. Cl. ..... 139/25; 139/26
(58) Field of Search ..... 139/25, 26

(56) References Cited

U.S. PATENT DOCUMENTS

| | | | | |
|---|---|---|---|---|
| 2,625,956 A | | 1/1953 | Sippel | |
| 4,974,639 A | * | 12/1990 | Maitan et al. | 139/25 |
| 5,099,890 A | | 3/1992 | Duetsch et al. | |
| 5,441,084 A | * | 8/1995 | Corain et al. | 139/25 |
| 5,458,160 A | * | 10/1995 | Geiger et al. | 139/25 |
| 6,112,773 A | | 9/2000 | Geiger | |

FOREIGN PATENT DOCUMENTS

| | | |
|---|---|---|
| DE | 2225604 | 7/1973 |
| DE | 19626417 | 3/1997 |
| EP | 0257857 | 3/1988 |
| EP | 0298454 | 1/1989 |
| EP | 0768407 | 4/1997 |
| EP | 0979891 | 2/2000 |
| FR | 892656 | 5/1944 |
| FR | 1258281 | 3/1961 |

OTHER PUBLICATIONS

Dipl.–Ing. J. Schneider, "Weberei Verfahren und Maschinen fuer die Gewebeherstellung" (Weaving Methods and Machines for Woven Cloth Production), published by Springer–Verlag Berlin/Göttingen/Heidelberg, 1961, pp. 17–19 and 277–279.

* cited by examiner

*Primary Examiner*—Andy Falik
(74) *Attorney, Agent, or Firm*—W. F. Fasse; W. G. Fasse

(57) ABSTRACT

Ground warp and pile warp thread sheets are supplied to a shed forming device. The ground warp and the pile warp are separately deflected over a deflecting rod upstream from the shed forming device. The deflecting rod supports the ground warp and directs the pile warp to cross and interpenetrate through the ground warp before deflecting the pile warp into the back shed. The deflecting rod is positively driven and controlled to pivot about a horizontal axis to provide a positive controlled partial compensation of the pile warp thread length variations. The pile warp also runs over a pile warp thread reserve and compensating device upstream from the thread crossing location to provide an additional passive uncontrolled compensation of the pile warp thread length variations and to provide a pile warp thread reserve during the pile loop formation and/or the shed changes in the weaving process.

20 Claims, 10 Drawing Sheets

REAR CLOTH EDGE POSITION

FRONT CLOTH EDGE POSITION
ECCENTRIC STROKE (mm)
0
90
180
270
360
REED BEAT-UP 1ST WEFT PICK
REED BEAT-UP 2ND WEFT PICK
GROUP BEAT-UP 3RD WEFT PICK

WARP SWITCHING OF THE PILE WARP (mm/MACHINE DEGREE)
1.
2.
3.

TERRY LOOM WITH PILE WARP LENGTH COMPENSATION AND DEFLECTION INTO BACK SHED

CROSS-REFERENCE TO RELATED APPLICATION

This application is related to U.S. patent application Ser. No. 09/855,150 filed on May 14, 2001 and now allowed. The entire disclosure of the related application is incorporated herein by reference.

PRIORITY CLAIM

This application is based on and claims the priority under 35 U.S.C. §119 of German Patent Applications 100 23 444.5 Ser. No. 09/855,150 filed on May 12, 2000, and 100 54 851.2 filed on Nov. 4, 2000, the entire disclosures of which are incorporated herein by reference.

1. Field of the Invention

The invention relates to a terry loom with a first thread supply arrangement for supplying a ground warp thread sheet and a second thread supply arrangement for supplying at least one pile warp thread sheet, shed forming elements for shedding the warp sheets, and cloth drawing-in means.

b 2.Background Information

Various methods and equipment are known for weaving a terry cloth with loops of a pile thread bound in by the weft threads. Typically, the pile loops are formed by a pile warp, while a further ground warp cooperates with the weft threads to form the base cloth. In this regard, the terry loom includes the components mentioned above and further includes weft insertion means and a reed or other weft beat-up means that cooperate with the above mentioned shed forming elements in a conventional manner.

More particularly, to form the terry cloth, the respective weft threads are first inserted and partially beat-up along a line at a prescribed spacing distance from the beat-up edge or cloth fell. Then, in a subsequent step the weft threads are fully beat-up against the beat-up edge of the cloth in a group-wise manner by performing a so-called full beat-up or group beat-up. While carrying out this group beat-up with the reed, the tension of the pile warp threads is reduced and additional lengths of the pile warp threads are supplied, so that the relatively loose pile warp threads are pushed along with the weft threads during the beat-up. Thereby the pile warp threads form pile loops puckering outwardly away from the base warp or ground warp. At the same time, the weft threads glide along between the ground warp threads, which are held under tension, until the weft threads reach their final beat-up position against the beat-up edge of the cloth.

These are merely the most basic aspects of the generally known technique of terry weaving, which is described in further detail, for example in the book "WEBEREI Verfahren und Maschinen fuer die Gewebeherstellung" (Weaving Methods and Machines for Woven Cloth Production") by Dipl.-Ing. J. Schneider, published by Springer-Verlag Berlin/Göttingen/Heidelberg, 1961, pages 17 and 277.

A typical example of a terry weaving loom is known from German Patent 2,225,604, which also illustrates and describes the basic construction of such a terry weaving loom. The ground warp threads are fed or let out from a ground warp thread beam and are deflected over a spring-loaded tensioning beam into the horizontal weaving plane, in which they are combined, and united with the pile warp thread sheet which is fed or let out from a pile warp thread beam located above the weaving plane. Thus, the pile warp thread sheet and the ground warp thread sheet are united to form a common warp thread sheet including the interspersed ground warp threads and pile warp threads. The pile warp threads are guided over their own separate spring-loaded tensioning beam which is arranged above the ground warp thread sheet and extends across the weaving width so as to direct and introduce the pile warp threads from above, essentially tangentially into the ground warp thread sheet.

Further according to DE 2,225,604, the ground warp threads and the pile warp threads run through warp thread stop motions arranged in the weaving plane. Then, behind or downstream of these stop motions, the ground warp threads and pile warp threads in common run through shed forming elements in the form of healds or heddles, and from there extend through the weaving reed to the woven web edge which forms the so-called beat-up edge. The loom shed that is formed by the heddles according to the selected weaving pattern has the shed vertex of the front shed defined along the beat-up edge, and ends with the shed vertex of the back shed in the area of contact rods of the warp thread stop motion that serves in common for monitoring the ground warp threads and the pile warp threads.

The weft threads are respectively inserted into the open shed by the weft insertion means. Then, the weaving reed, for example cooperating with or carried by a sley that is not shown in detail, carries out a back-and-forth weft thread beat-up motion having a constant amplitude. Thereby, the successive weft threads inserted into the loom shed are first partially beat up into a partial beat-up position at a spacing distance away from the beat-up edge of the woven cloth, and then respective successive groups of the partially beat-up weft threads are group-wise completely beat-up against the beat-up edge of the woven cloth. To achieve this, the breast beam is controlled by a so-called terry eccentric so that the breast beam moves toward the reed, whereby the woven cloth also moves toward the reed, so that the constant amplitude beating of the reed can carry out the complete or group beat-up of the weft threads against the beat-up edge of the woven cloth. During this motion of the breast beam, the warp thread sheet is held under tension by the spring-loaded tensioning beam. Since the entire woven cloth and warp thread sheet are moved cyclically in this known method, one speaks of a "woven web motion control" for the loop formation of the pile threads.

In the above described known method and equipment, problems can arise while guiding together and combining the pile warp thread sheet with the ground warp thread sheet, particularly because neighboring pile warp threads can become hung-up or caught on one another while being let off from the pile warp beam, or the neighboring pile warp threads may even become partially looped around one another and thus tangled. These problems are especially more likely to occur because the pile warp thread tension must be reduced during the group beat-up in order to form the pile loops in the pile warp threads. There are certain types of thread or yarn that have a particularly strong tendency toward such tangling, due to their characteristics, their thread structure, or the fiber material contained therein. If such pile warp threads that are hung-up or tangled with one, another are fed into a warp thread stop motion in common with the ground warp threads, or especially all the way to the back shed and to the heddles, there is a danger that warp thread breaks or at least weave defects will arise.

The removal or correction of warp thread breaks in the area of the back shed in such looms is particularly difficult because the warp thread stop motions and the warp thread area, between the stop motions and the tensioning roller for the pile warp threads is very difficult to access from the warp beam side. This is the case, because these areas are substantially covered by the pile warp thread sheet in the manner of a curtain that extends practically entirely down to the weaving plane. Thus, in order to remove or correct a warp thread break, the operating personnel must reach through and between the pile warp threads and then search for the broken warp thread ends that are to be connected to each other, using a wire hook or some other suitable tool.

Since the warp thread stop motions are arranged in an area of the back shed in which the pile warp thread sheet runs into the ground warp thread sheet at a rather small acute angle relative to the weaving plane, this leads to the additional problem that a relatively strong back and forth motion of the pile warp threads arises in the area of the warp thread stop motion during the shed forming and pile loop forming operations. Such strong motion of the pile warp threads is undesirable, for example due to rubbing wear of the threads and resultant formation of fly lint, especially when weaving with rather sensitive pile warp threads. Moreover, due to this arrangement of the warp thread stop motion directly in front of the area of the back shed, the warp thread movements also have a strong influence on the pile warp thread stop motion feelers during the group beat-up, with the result that forces arise in the pile warp threads, which act contrary to the pile loop forming process. In other words, the arising tension forces tend to hinder the proper formation of the pile loops in the pile warp threads during the group beat-up.

As described above, in the known terry loom according to German Patent Laying-Out Publication 2,225,604, only the breast beam is moved for achieving the required woven cloth motion control during the group beat-up, while the warp thread tension of the ground warp thread sheet is maintained by the corresponding allocated spring-loaded tensioning beam. On the other hand, European Patent Publication EP 0,768,407 A1 discloses a terry loom in which the required woven cloth motion control is achieved by the backrest beam or roller of the ground warp thread sheet being positively coupled through a linkage with the cloth drawing-in roller, so that these two components together carry out the relative motion with respect to the beat-up location of the reed, as required for the formation of the pile loops. By appropriately adjusting and controlling this coupling between the backrest beam and the cloth drawing-in roller, the pile height can be varied according to a selected pattern, as is known from the European Patent Publication EP 0,979,891 A1. Also in these known terry looms, the pile warp thread sheet runs over a spring-loaded compensating roller arranged above the weaving plane and the ground warp thread sheet, and from there runs at a small acute angle from above into the ground warp thread sheet. Thereby, the pile warp threads first interpenetrate between the ground warp threads in the area of the back shed. The warp thread stop motions can therefore only be arranged in the same manner as described above.

In order to provide the additional pile warp thread length that is needed for the proper loop formation during the group beat-up, German Patent Publication DE 196 26 417 A1 discloses a terry loom having a deflecting rod for the pile warp threads, whereby this deflecting rod is coupled with a pile warp thread tensioning device in the form of a tensioning roller. Particularly, the deflecting rod is arranged before or upstream of this pile warp thread tensioning device in the thread running direction, in such a manner so as to form a deflection location for the pile warp threads that essentially faces toward the rotation axis or pivot axis of the tensioning device. Thereby, the tension arising in the pile warp threads during the loop formation is compensated. However, also in this known terry loom, the pile warp threads run from above at a small acute angle relative to the weaving plane, coming directly from the pile warp thread tensioning device and from there being guided almost parallel to the weaving plane, so that the pile warp threads only run into the ground warp threads in the back shed. The arrangement of the warp stop motions is not shown in further detail in the reference.

In a different terry loom known from the European Patent Publication EP 0,257,857, the pile warp thread beam is arranged at the bottom, while the ground warp thread beam is supported at a spacing distance above the weaving plane. With this reversed arrangement of the warp beams, however, nothing else is changed with regard to the basic aspects and relationships described above in connection with other known terry looms. Namely, the pile warp threads finally run into, i.e. become interspersed with, the ground warp threads only in the area of the back shed, whereby the warp stop motions for both warp thread systems are arranged in or on the back shed, and both the pile warp threads and the ground warp sheds run in common through the warp stop motions. The ground warp thread beam and the cloth beam of this known terry weaving loom are driven with a constant rotational speed, while the ground warp thread let-off or feed is controlled dependent on the warp thread tension.

While the above described known looms use the so-called woven cloth motion control (i.e. controlled movement of the woven cloth) for carrying out the loop formation and the complete group beat-up, there are also other terry weaving looms in which the loop or pile formation is carried out with a so-called sley motion control, for example as described in the European Patent Publication 0,298,454 B1 and in the above mentioned technical reference book "WEBEREI" at page 277. In any event, even in such other terry weaving looms, the above described relationships and guidance of the ground warp threads and the pile warp threads are essentially carried out in the same manner as described above.

SUMMARY OF THE INVENTION

In view of the above, it is an object of the invention to provide a terry weaving loom that can achieve an increased operational reliability and an improved serviceability in comparison to the prior art, so that machine down times or stop times are reduced and the cloth production output is increased. The invention further aims to avoid or overcome the disadvantages of the prior art, and to achieve additional advantages, as apparent from the present specification.

The above objects have been achieved according to the invention in a terry weaving loom system including a first thread supply arrangement for supplying a ground warp thread sheet, a second thread supply arrangement for supplying a pile warp thread sheet, woven cloth drawing-in means, at least one warp stop motion, shed forming elements for shedding the warp thread sheets, weft insertion means, and weft beat-up means which move back and forth to beat-up the inserted weft threads while forming terry pile loops of the pile warp threads. Further according to the invention, the pile warp thread sheet intersects and crosses through the ground warp thread sheet in an area between the back shed formed by the shed forming elements and the first thread supply arrangement for supplying the ground warp thread sheet. Especially also according to the invention, the loom system further comprises a pile warp thread reserve and compensating device, which achieves a compensation of the pile warp thread length variations during the pile loop formation and/or the shed changing. To achieve this, the pile warp thread sheet is guided over the pile warp thread reserve and compensating device at an area upstream from the crossing location at which the pile warp thread sheet intersects with and crosses through the ground warp thread sheet.

The above objects have further been achieved according to another embodiment of the invention in a terry weaving loom system having the same general construction as that described above, but without necessarily including the above mentioned pile warp thread reserve and compensating device. Instead, the present embodiment includes thread deflection means comprising at least one deflecting rod that extends along the weaving width and is, supported by support elements so as to be pivotably movable about a horizontal axis. In this regard, the horizontal axis is defined and provided by a horizontally axially extending shaft, and the support elements comprise support levers that are secured against rotation on the shaft, i.e. so that the support levers will pivot or tilt together with the shaft about the axis thereof. The arrangement further includes at least one drive connected to the shaft for controlledly and freely programmably controlling the position and motion of the pile warp deflecting rod. The pile warp deflecting rod is arranged on the side of the ground warp thread sheet opposite the second thread supply arrangement for supplying the pile warp thread sheet. This causes the pile warp thread sheet to intersect with and cross through the ground warp thread sheet.

Thereby, the pile warp threads are guided to penetrate through the ground warp thread sheet so as to form a thread cross of the pile warp threads and the ground warp threads. Due to such a thread cross arrangement, any warp thread break in the area of the back shed can be easily observed and recognized and then simply removed or corrected by the operating personnel. In a particularly advantageous embodiment of the invention, the pile warp thread sheet is guided through the ground warp thread sheet so as to interpenetrate and intersect the ground warp thread sheet in a cross configuration, particularly at a steep angle, for example between 45 and 135°, or particularly between 75 and 135°, or more particularly 70 to 130°, or even 80 to 100°, as measured between the pile warp thread sheet and the ground warp thread sheet on the upstream or supply side thereof relative to the thread intersection or crossing point. This intersection or crossing point is located in an area between the back shed of the pile warp threads formed by the shed forming elements such as heddles, and the warp thread supply arrangement supplying the ground warp thread sheet.

Since the pile warp thread sheet is guided through, i.e. intersecting, the ground warp thread sheet outside of and upstream from the back shed, there is formed a thread cross of the pile warp threads and the ground warp threads as mentioned above, which ensures a reliable separation of the individual pile warp threads or pile warp thread groups from each other, because they are respectively interspersed between successive ground warp threads. Depending on the binding pattern, either properly separated individual pile warp threads, or groups of pile warp threads (generally at most two threads) corresponding to the pattern repeat, are guided respectively to the individual heddles, whereby the threads in such groups can be arranged lying side-by-side next to one another or one over another. Due to the thread cross formed in this manner, any arising warp thread break in the area of the back shed may be easily observed and recognized, and then removed or corrected without difficulties from the warp beam side or from the woven cloth drawing-off side.

As mentioned above, the inventive terry weaving loom advantageously includes deflecting means, i.e. a deflecting element such as a deflecting rod, for deflecting the pile warp threads. The deflecting element or deflecting means may comprise at least one deflecting rod over which the pile warp thread sheet is deflected and guided. The deflecting rod can be embodied as a jointed rod which is respectively braced and supported at several locations across the weaving width. In order to keep the frictional forces low the deflection rod can be rotatably supported, and it can also be advantageous to support the deflection rod in a spring-loaded yieldable or movable manner, and also mechanically adjustably.

Depending on the spatial characteristics and the particular construction of the loom at hand, the inventive arrangement can be carried out in such a manner that the pile warp thread sheet and the ground warp thread sheet form an acute angle or an obtuse angle with respect to each other at the thread crossing location, as seen in the thread running direction. Particularly, the two warp thread sheets can cross each other at an angle of approximately 90°, e.g. in the range from 800 to 100°.

The warp thread guidance with the formation of a thread cross between the pile warp threads and the ground warp threads makes it possible to provide separate warp thread stop motions respectively for the ground warp thread sheet and for the pile warp thread sheet, whereby these separate warp stop motions are each freely accessible from at least one machine side, i.e. the warp beam side or the woven cloth side.

Preferably, the warp stop motion for the ground warp thread sheet and the warp stop motion for the pile warp thread sheet are arranged on two different planes that are spaced vertically and horizontally from one another, whereby generally the accessibility is further improved. Particularly, at least the pile warp thread sheet is guided in a preferably horizontal plane in the area of the pile warp thread stop motion. Especially due to the arrangement of the pile and ground warp thread stop motions in two different planes, the removal or correction of warp thread breaks, especially in the area of the back shed, becomes especially user friendly.

Another advantage is that the deflection point provided by the deflecting rod is directly adjacent to the thread cross mentioned above. This deflection location of the pile warp threads serves to avoid a strong back-and-forth movement of the pile warp threads in the area of the pile warp thread stop motion. Additionally, the pile warp thread sheet is preferably guided over an arrangement for forming a pile warp thread reserve in an area lying before or upstream of the thread crossing location at which the pile warp thread sheet intersects and penetrates through the ground warp thread sheet, as seen in the thread running direction. This arrangement for forming a pile warp thread reserve serves to compensate the length of the pile warp threads during the pile loop formation and/or during the shed changing. This arrangement for forming a pile warp thread reserve can comprise at least one spring-loaded yieldingly supported thread length compensating element, which the pile warp threads at least partially loop around or over. For example, this element may be a spring-elastically supported deflecting rod or a spring-yielding or yieldingly supported thread deflecting metal sheet or plate.

The above described guidance of the warp threads makes it possible to store the required or the arising pile warp thread length for the thread formation during terry weaving with woven cloth motion control or with sley motion control (as respectively described above) in such a manner so that the pile warp thread tension is reduced before the group beat-up, and the spring-loaded deflecting rod or the spring sheet metal deflecting plate or sheet at least partially takes up the pile warp thread length. Thereby it is achieved that the group beat-up does not have such a strong effect on the pile warp stop motion feelers as was the case in the prior art, so that thread tension forces that would be contrary to the pile loop forming process are minimized.

In the second embodiment of the invention, the thread deflecting rod is supported on rocking or pivoting levers, so that the deflecting rod can be driven in a controlled pivoting manner about the horizontal axis during the partial shifting of the woven terry cloth for carrying out the terry beat-up and pile loop formation. On the other hand, in the first embodiment of the invention, the deflecting rod is simply elastically spring mounted so that it is elastically yieldable and pivotable in a passive, uncontrolled manner about a pivot axis for achieving an uncontrolled or passive tension compensation of the pile warp thread sheet. In comparison, in the second embodiment, the tension compensation during the shifting of the woven web is carried out in a controlled active manner according to a freely adjustable or selectable control program (e.g. through the loom controller). Particularly, the horizontal pivoting axis is provided by a rotatably supported shaft, which is operatively connected to a reversible drive, e.g. preferably an electric motor drive with a reversible rotation direction. This drive actuates the deflecting rod into a controlled pivoting motion via the support levers connected to the horizontally extending shaft.

By means of this controlled pivoting motion of the deflecting rod, the pile warp thread tension is actively maintained at the desired or required tension level during the partial shifting of the woven cloth after the so-called group beat-up. In this manner, it is ensured that the terry pile loops that have been formed in the pile warp threads are not even partially pulled out of the woven cloth. As a result, a very uniform terry pile with a low defect rate can be achieved.

According to further details of the invention, the controlled pivoting motion of the deflecting rod can be achieved in that the horizontally extending shaft is operatively connected to a rotationally driven cam disk which correspondingly drives the shaft, either directly or through suitable transmission means. The drive of this cam disk can be derived from the main drive shaft of the loom, or can be provided by an electric motor drive that is independent of the main drive of the loom.

BRIEF DESCRIPTION OF THE DRAWINGS

In order that the invention may be clearly understood, it will now be described in connection with example embodiments, with reference to the accompanying drawings, wherein.

Figure 1:
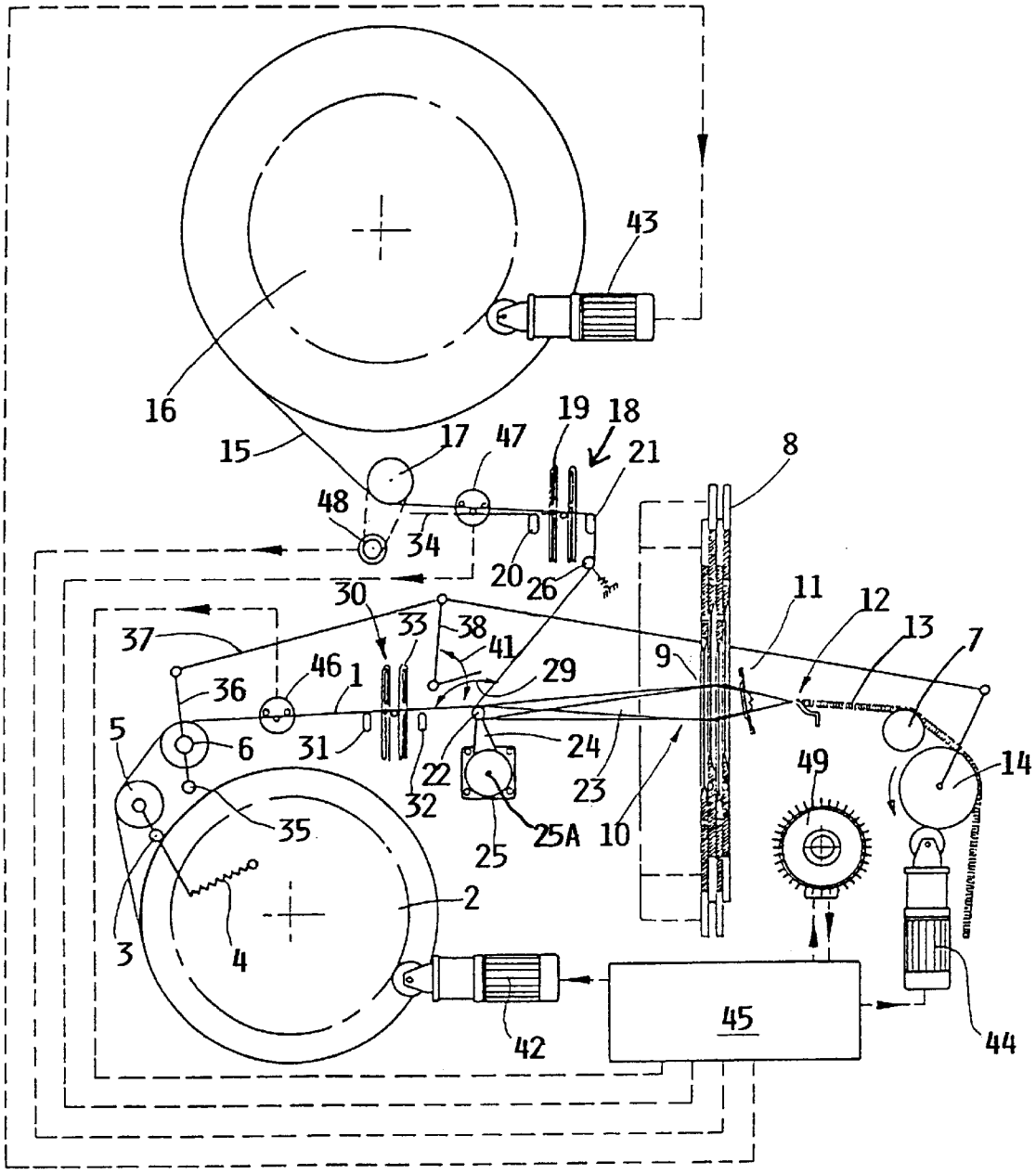
FIG. 1 is a schematic side view of a terry weaving loom according to the invention, essentially as seen on a section plane along the weaving direction.

DETAILED DESCRIPTION OF PREFERRED EXAMPLE EMBODIMENTS AND OF THE BEST MODE OF THE INVENTION

FIGS. 1 to 8 merely schematically show the most important essential components of various different embodiments of a terry weaving loom according to the invention. Each of these different embodiments of a terry weaving loom comprises a first thread supply arrangement for supplying a base or ground warp thread sheet 1, and a second thread supply arrangement for supplying a pile warp thread sheet 15, which is located above the first thread supply arrangement in the illustrated embodiments but could alternatively be the opposite.

The first thread supply arrangement includes a ground warp thread beam 2 from which the ground warp thread sheet 1 is guided over a tensioning roller 5, and a backrest beam 6 which deflects the ground warp thread sheet 1 into the essentially horizontal working or weaving plane above the ground warp thread beam 2. The tensioning roller 5 is tiltably or pivotally supported about the fixed axis 3, and is coupled to spring means 4 that exert a spring bias on the pivoting or tilting of the tensioning roller 5. The back rest beam 6 may, for example, be a backrest roller or whip roll.

Shed forming elements, e.g. in the form of a heald shaft 8 with healds or heddles 9, are arranged between the backrest beam 6 and a breast beam 7. These shed forming elements are moved up and down by means of any conventionally known, mechanism (which has been omitted from the drawings for the sake of simplicity and clarity) for carrying out the shed formation to form an open shed 10 in any known manner. Weft thread insertion means (which are not shown) are further allocated to the shafts 8, and may comprise pneumatic nozzles to which pressurized air is supplied, mechanical grippers, shuttles, or any other conventionally known weft insertion arrangement, depending on the type of construction of the respective terry weaving loom. In any event, the weft threads are inserted into the open loom shed 10, and are then beat-up respectively in a group wise manner against the beat-up edge 12 of the woven cloth 13 using a weft beat-up means in the form of a weaving reed 11, which carries out the beat-up in any conventionally known manner in the art of terry weaving.

The woven cloth 13 is guided over the breast beam 7 and then over a drawing-in roller 14 embodied as a needle roller or spiked roller, from which the woven cloth 13 is transported further to a cloth beam (not shown) on which the woven cloth is ultimately rolled or wound up. The reed 11 is rigidly mounted on a sley (see e.g. FIG. 8) and together with the sley carries out a back-and-forth motion between a back or rear position relative to the thread running direction, and forward beat-up position. In the embodiments of the terry weaving looms shown in FIGS. 1 to 6, the stroke of this back-and-forth motion of the reed 11 is constant. In other words, the loom embodiments shown in FIGS. 1 to 6 use a so-called woven cloth motion control, whereby the woven cloth is moved back-and-forth to cooperate in carrying out the complete group wise beat-up of the weft threads against the beat-up edge of the woven cloth 13 while forming the terry pile loops of the pile warp threads.

The second warp thread supply arrangement for supplying the pile warp thread sheet 15 is arranged at a spacing distance above the ground warp thread beam 2 and the working or weaving plane. The second warp thread supply arrangement includes a pile warp thread beam 16 from which the pile warp thread sheet 15 is fed or let-off in a controlled manner. In the embodiment according to FIG. 1, the pile warp thread sheet 15 coming off from the pile warp thread beam 16 is first deflected over a rotatably supported deflects roller 17 into an essentially horizontal plane in which the pile warp threads extend through a warp thread tension sensor 47 and then through the vertically arranged warp thread stop motion feelers 19 of a pile warp stop motion 18. Such a pile warp stop motion 18 can have any generally known construction and operation, for example as, described in the above mentioned book "WEBEREI Verfahren und Maschinen fuer die Gewebeherstellung" published by Springer Verlag, 1961, at page 421 et seq. On both sides of the stop motion feelers 19, the pile warp, thread sheet 15 is supported on rods 20 and 21 that extend continuously along the weaving width, whereby the rod 21 arranged generally adjacent to the heald shafts 8 deflects the pile warp thread sheet 15 guided thereover by about 90° into an essentially vertical plane extending downward. Nonetheless, a deflection of more or less than 90° is also possible.

As mentioned above, the ground warp thread sheet 1 runs along the essentially horizontal working or weaving plane. Below this plane, a deflecting element in the form of a deflecting rod 22 is arranged in a rotatably supported manner. This rod 22 extends across the weaving width while being supported and braced at plural locations therealong. The pile warp thread sheet 15, which comes (either directly or indirectly as will be further discussed below) from the above mentioned rod 21 adjacent to the stop motion 18, is deflected around the deflecting rod 22 into the essentially horizontal working or weaving plane and particularly into the back shed 23 of the loom shed 10.

The deflecting rod 22 is positioned in such a manner so that it supports the ground warp thread sheet 1 from below (i.e. on the top surface of the rod 22), while deflecting the pile warp thread sheet 15 from above (i.e. around the back and bottom surfaces of the rod 22). In other words, the ground warp thread sheet 1 and the pile warp thread sheet 15 respectively contact opposite sides of the deflecting rod 22 as these respective warp thread sheets are then deflected toward the shedding elements to form the respective back sheds 23. Thereby, the back shed vertex of the back shed 23 of the ground warp threads as well as the back shed vertex of the back shed 23 of the pile warp threads respectively lie on the deflecting rod 22, and particularly on opposite sides of the deflecting rod 22. Thus, the vertex of the back shed of the ground warp threads is not coincident with the vertex of the back shed of the pile warp threads, but rather the deflection rod 22 separates the respective back shed vertices from each other.

It is also evident that the pile warp thread sheet 15 is caused to intersect and interpenetrate through the ground warp thread sheet 1 at a thread crossing location directly upstream from the back shed vertex of the back shed of the ground warp threads, due to the pile warp threads extending around the back side of the deflecting rod 22 before being deflected around the bottom of the rod 22 into the back shed 23.

As mentioned above, the deflecting rod 22 is rotatably supported in the preferred embodiment (see arrow 22A in FIG. 3A), but alternatively, it could be non rotatably mounted, and/or replaced by plural separate deflecting rod segments and/or roller segments (see 22', 22" and 22'" in FIG. 3A) around which respective subsets of the pile warp thread sheet 15 are looped and deflected. Preferably, the deflecting rod 22 is supported by levers 24 to be tiltable or pivotable (arrow 24A in FIG. 3A) about a horizontal axis 25A of a shaft 25, against the biasing force applied by spring means 25B which exert a biasing force tending to hold the pile warp thread sheet 15 under tension. In other words, the spring means 25B urge the deflecting rod 22 to pivot away from the shedding means. In this manner, the spring-loaded deflecting rod 22 achieves a pile warp thread length compensation to compensate for variations of the pile warp thread lengths being utilized during the weaving process and particularly in the shed changes and in the pile loop formation steps.

Alternatively or additionally, a spring-loaded compensating roller 26 can be arranged in the thread path between the rod 21 associated with the downstream side of the pile warp thread stop motion 18, and the deflecting rod 22. Such a spring-loaded compensating roller 26 is shown in. FIG. 1, in a position in which the pile warp threads partially loop around it, so as to take up the varying pile warp thread lengths for the sake of a warp thread length compensation, during the shed changes and pile loop formation in the weaving process. The compensating roller or shaft 26 may alternatively be replaced by a rigidly located rotatably supported shaft or a deflecting rod.

Figure 5:
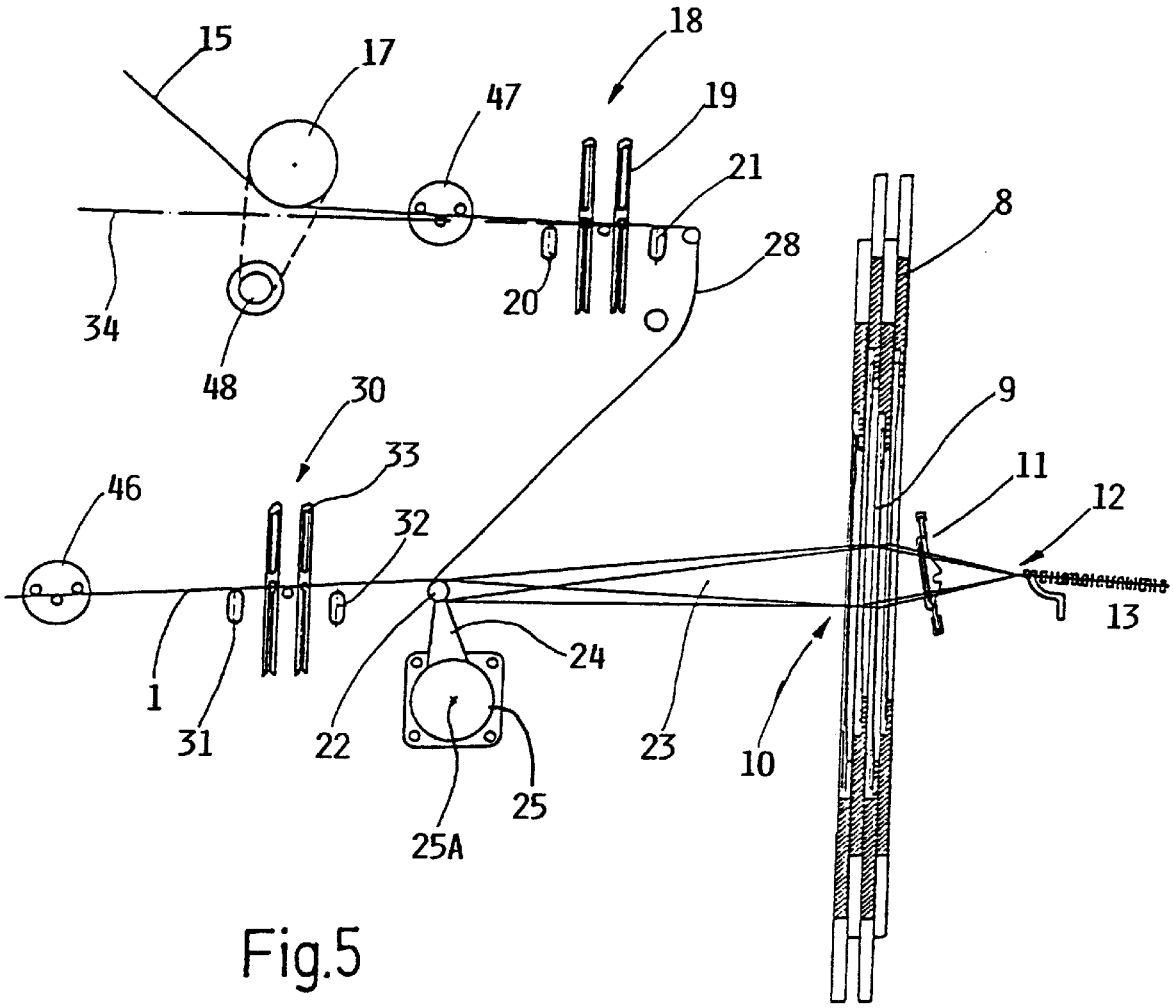
FIG. 5 is an enlarged schematic detail portion of the terry weaving loom according to FIG. 4, emphasizing the warp thread crossing location.

As a further alternative or additional feature, a thread deflecting metal sheet or plate 28 extending continuously across the weaving width can be arranged in thread running path of the pile warp thread sheet 15 at a location downstream from the rod 21 in the thread running direction. Such an arrangement is shown in FIG. 5. This deflecting sheet or plate 28 is preferably made of an elastically deflectable spring character metal sheet that is bent or curved to smoothly deflect the pile warp threads. Thereby, the sheet or plate 28 acts as a deflectable spring element, to function just like a spring-loaded compensating shaft or roller 26 according to FIG. 1. Namely, this element helps to compensate or take-up the pile warp length variations while isolating the effects of such variations from the warp stop motion feelers 19, thereby "calming" the warp thread stop motion feelers 19.

It should further be noted in connection with FIG. 3A, that the deflecting rod 22 arranged below the ground warp thread sheet 1 can be adjustably supported by means of its bearing levers 24 about the axis 25 or particularly the axis 25A of the shaft 25, in any known manner of mechanical adjustment so that the deflection point of the pile warp thread sheet 15 and thereby also its crossing point with respect to the ground warp thread sheet 1 is adjustable in a direction extending toward the heald shafts 8, either toward or away from the heald shafts 8.

The pile warp thread sheet 15 is guided and deflected by the compensating shaft or roller 26 and the deflecting rod 22 in such a manner that it intersects the ground warp thread sheet 1 at the crossing location at an obtuse angle 29 of about 130°, as seen in the thread running direction, in the illustrated example embodiment of FIG. 1. By adjusting the compensating shaft 26 and/or the deflecting rod 22, the magnitude of this angle 29 can be adjusted as needed for any particular application, and thereby can be adjusted to meet the particular requirements or purposes at hand.

The ground warp thread sheet 1 is guided through a warp thread stop motion 30 which monitors the ground warp threads for the occurrence of a warp thread break, at a location between the backrest beam 6 and the deflection rod 22, i.e. the shed vertex of the back shed 23, as seen in the thread running path direction. Particularly, the warp thread stop motion feelers 33 or lamellae 33 ride along on the ground warp threads, which are guided along an essentially horizontal path over two support rods 31 and 32. The warp thread stop motion 30 is basically of the same construction and operation as the warp thread stop motion 18 for the pile warp thread sheet 15.

Since the warp thread stop motion 30 for the ground warp thread sheet 1 is arranged to the left of the pile warp thread sheet 15 in the arrangement of FIG. 1, it is clearly evident that this stop motion 30 is easily accessible for maintenance or the like from the warp beam side, because it is exposed at this machines side and particularly is not covered by the pile warp thread sheet 15.

The warp thread stop motion 18 for the pile warp thread sheet 15 is arranged on a substantially horizontal plane 34 illustrated with a dash dotted line in FIG. 1, whereby this plane 34 is a separate plane from the plane on which the warp thread stop motion 30 for the ground warp threads is arranged. Moreover, this plane 34 of the stop motion 30 is arranged at a spacing distance above the working or weaving plane and therewith at a spacing distance away from the ground warp thread sheet 1 running through the other warp thread stop motion 30. This warp thread stop motion 18 for the pile warp thread sheet 15 is thus freely accessible from the woven cloth take-off or drawing-off side of the machine (i.e. to the right in FIG. 1), so that it is also simple to remove or correct pile warp thread breaks in an unhindered manner from this side.

Generally summarizing the above, the key described concepts of the inventive arrangement are as follows. The respective warp stop motions 18 and 30, for the pile warp thread sheet 15 on the one hand and for the ground warp thread sheet 1 on the other hand, are arranged on separate planes in the loom. The pile warp thread sheet 15 is guided in such a manner so that it intersects and penetrates through the ground warp thread sheet 1 in a thread crossing structure with a rather large angle, for example in a range around 90°. This crossing location of the two warp thread sheets is upstream of the vertex of the back shed, i.e. toward the respective warp thread supplies. Also, the deflecting rod achieves a positive separation of the two warp thread sheets from each other, and locates the two vertices of the back shed of the ground warp and the back shed of the pile warp respectively separate from each other on opposite sides of the deflecting rod. These features together achieve an especially user-friendly, ergonomically advantageous, compact and simple construction of the entire terry weaving loom.

The additional components of the terry weaving loom that are merely schematically illustrated in FIG. 1 and the subsequent figures need only to be briefly discussed in order to facilitate an overall understanding of the entire machine and its operation. The backrest beam 6 is rotatably supported at both ends thereof on respective rockers 36 pivotably supported on a horizontal axis. The rockers 36 are coupled via a coupling rod linkage 37 with the woven cloth drawing-in roller 14 and with a double-armed adjusting lever 38 for the woven cloth control. The springs-loaded adjusting lever 38, which is embodied in the form of an angle lever or bellcrank lever, is cyclically tilted or pivoted back-and-forth about a fixedly located axis 40 in a direction corresponding to the arrow 41 shown in FIG. 1, by means of a terry eccentric 39 shown in FIG. 6. Thereby, the woven web beat-up edge 12 is brought closer to the reed it for carrying out the group wise beat-up of the weft threads. On the other hand, subsequently for carrying out the partial beat-up of the weft threads, once again the woven cloth beat-up edge 12 is moved a prescribed spacing distance away from the reed 11. This woven cloth motion control by itself is known as such, and is described, for example with a pile height adjustment capability, in the patent publications EP 0,979,891 A1 and 0,768,407 A1.

The warp beam 2 of the ground warp thread sheet 1, the warp beam 16 of the pile warp thread sheet 15, and the woven cloth drawing-in roller 14 are respectively individually driven by individual allocated drive motors 42, 43 and 44, which respectively control the warp feed or letting-off of the ground warp threads and the pile warp threads, and the drawing-off of the woven cloth 13. In this regard, to control the respective motors, a machine controller unit 45 incorporating a computer central processing unit (CPU) is provided. This machine controller unit 45 receives and processes electrical signals coming from respective warp thread tension sensors 46 or 47, which respectively monitor the tension in a respective representative number of ground warp threads or pile warp threads. The machine controller further receives and processes information or data regarding the used warp thread lengths, as provided by a sensor 48 coupled with the deflecting roller 17. The machine controller unit 45 additionally receives and processes information or data provided by an incremental encoder wheel 49 that is driven by the loom main shaft, whereby this data contains information about the progression of the various motion sequences derived from the loom main shaft for carrying out the shed formation and the motion of the reed 11. Stated briefly, in this terry weaving loom, the ground warp thread sheet 1 is guided with positive control via a backrest/breast beam system with warp thread length compensation by means of springs 4. The warp thread tension sensors 46 and 47 are respectively arranged before the warp thread stop motions 30 and 18 respectively seen in the thread running direction, in other words at an area with a relatively calm undisturbed running of the warp threads.

Figures 9A, 9B:
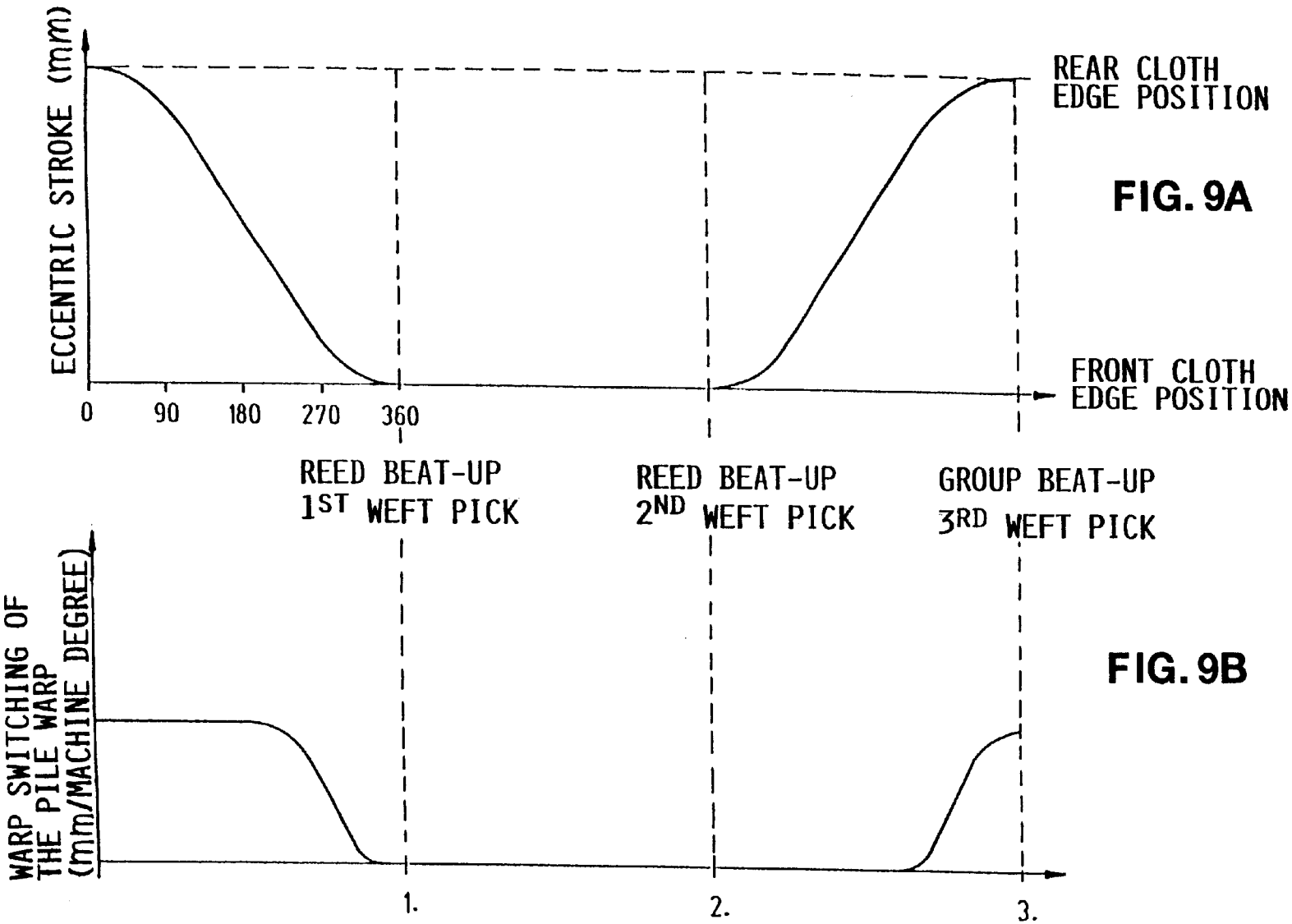
FIGS. 9A and 9B are diagrams illustrating the motion of the woven cloth and the letting out of the pile warp threads in connection with the woven cloth control of the terry weaving loom according to FIG. 1.

The basic function of the woven cloth motion control during terry weaving with the terry weaving loom is illustrated in FIGS. 9A and 9B. The upper illustration of FIG. 9A shows the eccentric stroke of the terry eccentric 39 (see FIG. 6) dependent on its rotational angle, while the lower illustration of FIG. 9B shows the pile warp thread feed or letting of as controlled by the drive motor 43. Beginning from the rear or back position of the beat-up edge in which the preceding group weft thread beat-up has taken place, the beat-up edge 12 is moved or transferred to the forward or front position, in which the beat-up edge 12 is located a further distance away from the reed 11. During this shifting of the beat-up edge 12, the required pile warp thread length is let-off so that the pile warp thread tension is maintained approximately constant.

Thereafter, respective first and second weft threads are inserted into the shed 10 formed respectively of ground and pile warp threads, and then these weft threads are partially beat-up by the reed 11 into a partial beat-up position at a spacing distance away from the beat-up edge 12. Next, the terry eccentric 39 once again moves the beat-up edge 12 into the rear or back position. During this process, a third weft thread is inserted, in the case of producing a so-called three shot or three weft terry cloth. Due to the shifting of the beat-up edge into the rear or back position, the pile warp tension is reduced. The compensating roller or shaft 26 meanwhile maintains the pile warp tension while taking up the thereby resulting additional length or reserve of the pile warp threads. After the shed change, the three inserted weft threads are beat-up in common as a group against the beat-up edge 12 by means of the reed 11 carrying out a group beat-up. During this group beat-up, the lengthening or reserve of the pile warp threads that has been taken up by the compensating roller or shaft is used up, particularly by forming the terry pile loops. This process is carried out in a similar manner when producing a four, five or six weft terry cloth.

Figure 2:
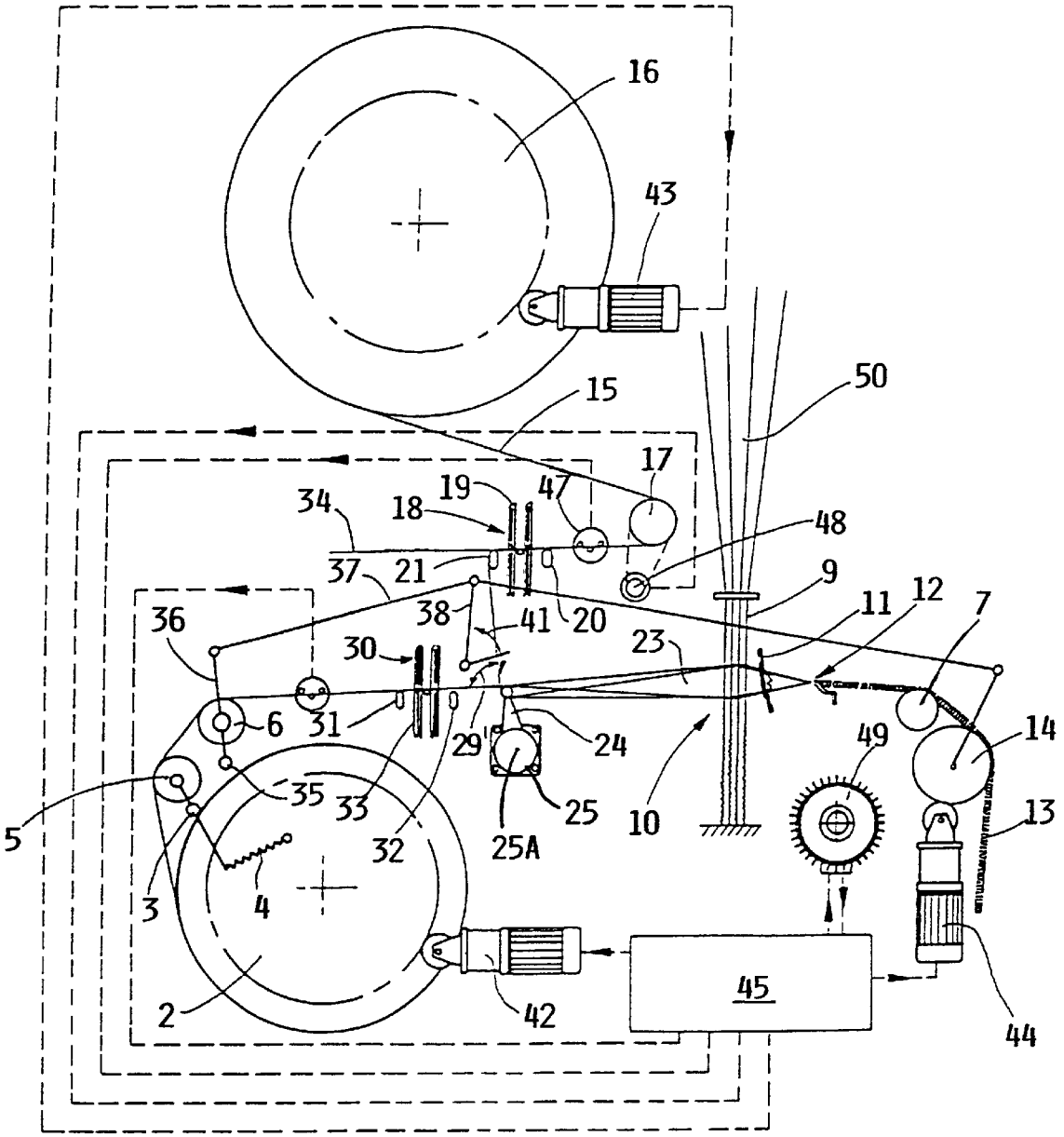
FIG. 2 is a schematic side view of an alternative embodiment of a jacquard terry weaving loom according to the invention, generally corresponding to the view of FIG. 1.

A jacquard terry weaving loom is illustrated in FIG. 2, whereby the basic construction of this loom corresponds to that of the terry weaving loom described above in connection with FIG. 1. The same or corresponding components are therefore identified with the same reference numbers, and will not be described redundantly here. Instead, only the differences will now be described.

This jacquard terry weaving loom of FIG. 2 comprises a harness 50 including cords that extend to and support the heddles 9. In this arrangement, the harness cords cover the warp stop motion 18 for the pile warp thread sheet 15 and the stop motion 30 for the ground warp thread sheet 1 from the woven cloth drawing-in side. Thus, the warp stop motion 18 for the pile warp thread sheet 15 is shifted more toward the warp beam side in comparison to the structural relationships in the terry weaving loom according to FIG. 1, so that it is comfortably accessible from the warp beam side by the operating personnel. To achieve this, the deflecting roller 17 is displaced closer to the woven cloth drawing-in roller 14 and serves to turn or wrap the pile warp thread sheet 15 by almost 360°, or particularly by a direction reversal of about 340° in the illustrated embodiment. This could also be understood as a deflection of nearly 180°, e.g. 160° in the illustrated embodiment, or generally at least 120°, or especially at least 150°. In the area of the pile warp thread stop motion 18, the pile warp thread sheet 15 is once again guided in an essentially horizontal plane 34. Then the pile warp thread sheet 15 is deflected downwardly by about 90° about the deflecting rod 21, and penetrates through the ground warp thread sheet 1 lying in the working or weaving plane at an acute angle 29', with a magnitude that may be about 90°.

Figure 3:
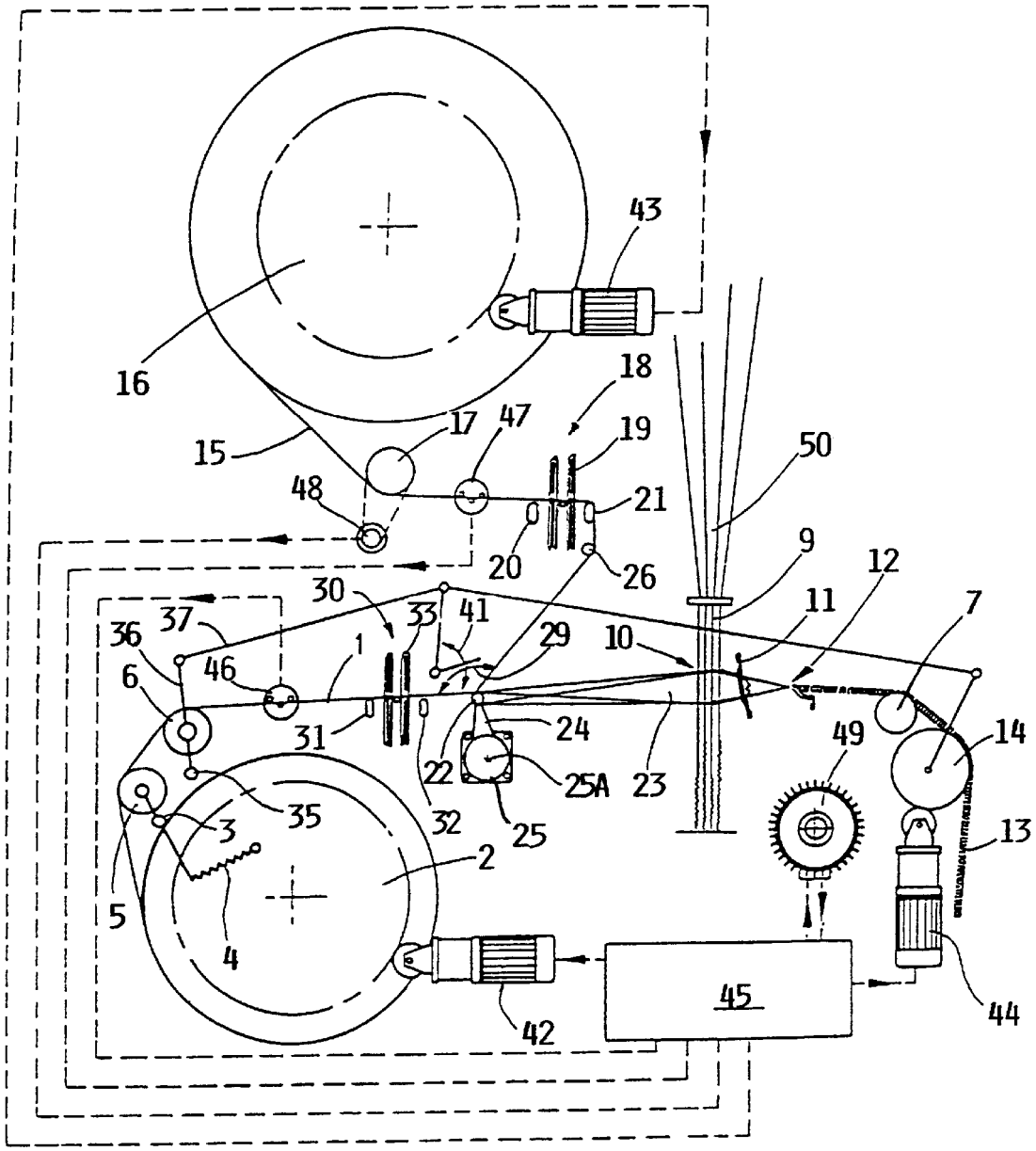
FIG. 3 is a schematic side view of a further modified embodiment of the jacquard terry weaving loom according to FIG. 2, whereby the view corresponds to that of FIG. 1.

Alternatively, it is basically also possible for the pile warp thread guidance in such a jacquard terry weaving loom to be configured similar to that of the terry weaving loom according to FIG. 1, if the structural characteristics of the respective machine, i.e. the respective loom, make such a configuration advantageous or useful. Such a variant of a jacquard terry weaving loom is shown in FIG. 3. In this case, the pile warp threads cross the ground warp threads at the crossing location adjacent to and just upstream of the deflecting rod 22, for example at the obtuse angle 29, corresponding to the situation illustrated and discussed above in connection with FIG. 1. It is basically further possible to shift the warp stop motion 18 of the warp thread sheet 15 further toward the warp beam side (i.e. to the left in FIG. 3.), if this would be advantageous or suitable in any particular application. In any event, however, the pile warp threads and the warp stop motion feelers 19 will remain easily accessible from the warp beam side of the loom, while the warp stop motion 30 of the ground warp thread sheet 1 is comfortably serviceable and accessible in any case from the warp beam side.

Figure 4:
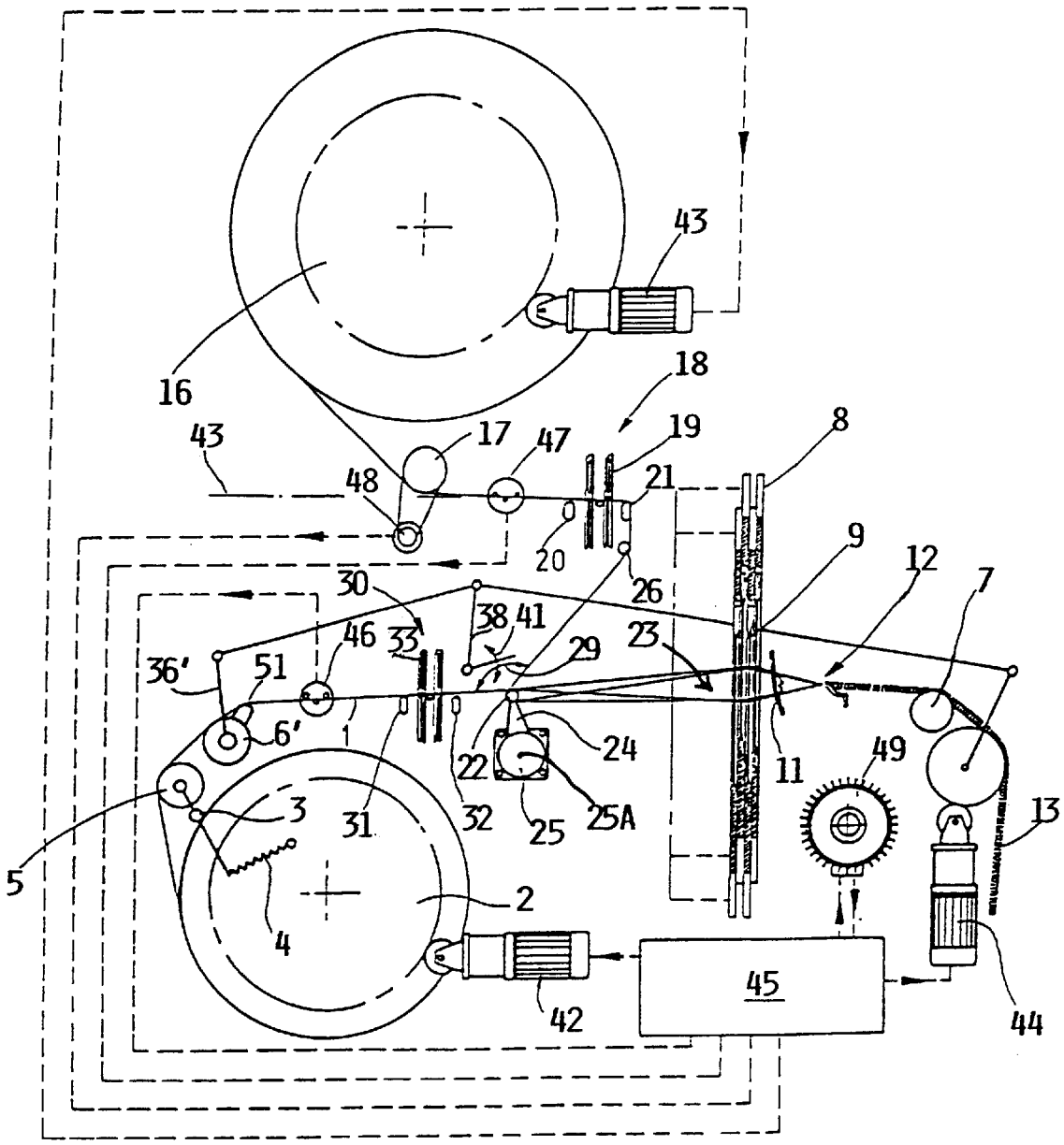
FIG. 4 is a schematic side view of the terry weaving loom according to FIG. 1, but in a further modified embodiment.

The further embodiment of a terry weaving loom according to FIG. 4 is constructed largely the same as the one according to FIG. 1. The primary difference is that the loom according to FIG. 4 does not have a backrest beam 6 pivotably supported on rockers 36 like the loom of FIG. 1. Instead, the loom of FIG. 4 has a backrest, beam 6' that is rotatably supported and that has an elongated cam 51 that protrudes radially outwardly from the backrest beam 6' at one location on the circumference thereof, and that extends along the beam 6' lengthwise parallel to the axis of the beam 6' across the entire weaving width. Depending on the rotational position of the backrest beam 6', the ground warp thread sheet 1 will either rest on the cylindrical outer contour of the backrest beam 6' or will be deflected further and supported by the protruding elongated cam 51.

For carrying out the group beat-up of the weft threads in connection with a woven cloth motion control as described above, the beat-up edge 12 of the cloth 13 is moved in a direction contrary to the thread running direction, i.e. toward the left in FIG. 4. Simultaneously, the backrest beam 6' is rotated in a counter-clockwise direction, starting from the initial position shown in FIG. 4, in common together with the woven cloth drawing-in roller 14 by the terry eccentric 39 (see FIG. 6). Thereby the ground warp thread sheet 1 is moved in common together with the woven cloth 13, toward the left with reference to FIG. 4. After completion of the group beat-up of the weft threads, the backrest beam 6' is again turned back to its initial position shown in FIG. 4, whereby the woven cloth 13 and the ground warp thread sheet 1 once again take up the respective positions necessary for carrying out the partial beat-up of the weft threads.

Figure 6:
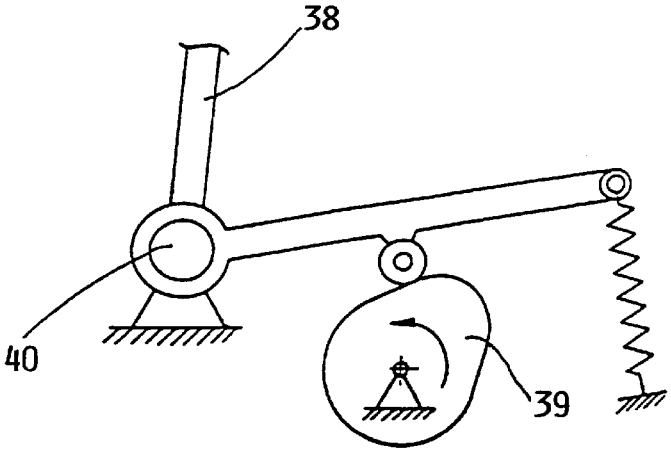
FIG. 6 is an enlarged detailed schematic side view of the terry weaving eccentric mechanism of the terry weaving loom according to FIG. 4.

An advantage of the construction of FIG. 4 is that it is somewhat simpler than the construction according to FIG. 1, because the rockers 36 for supporting the backrest beam 6' according to FIG. 1 have now been replaced simply by a single crank lever 36', which appropriately rotates the backrest beam 6', under the control of and coupled to the terry eccentric 39 (see FIG. 6). Since the deflecting rod 22, which guides the pile warp thread sheet 15 tangentially into the back shed 23, is arranged below the ground warp thread sheet 1, the short or intermittent lifting of the ground warp thread sheet 1 occurring during the above described pivoting, rotation of the backrest beam 6' between the two angular positions mentioned above is not hindered by the feeding and crossing of the pile warp thread sheet 15 through the ground warp thread sheet 1 and into the back shed 23. Namely, while the ground warp threads are being temporarily lifted by the elongated cam 51 of the beam 6', they simply slide for a short time up-wardly along the interpenetrating pile warp threads that are supplied steeply from above to the deflecting rod 22, and then again glide downwardly along the pile warp threads until they once again come to rest on the deflecting rod 22.

Figures 7, 8:
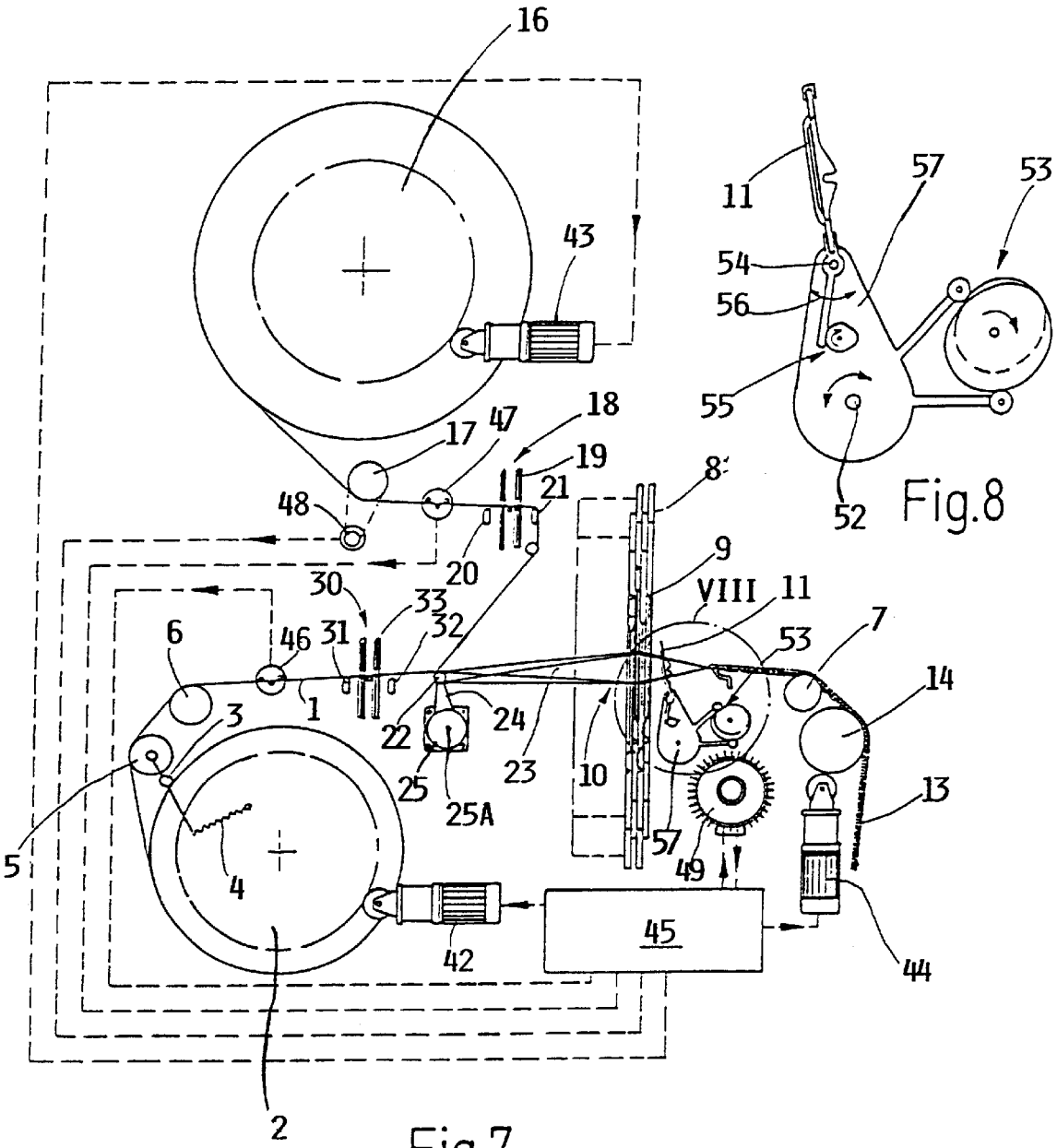
FIG. 7 is a schematic side view of a terry weaving loom generally similar to that of FIG. 1, but alternatively with a sley motion control rather than a woven cloth motion control.
FIG. 8 is an enlarged detail view of a portion VIII of the sley motion control mechanism of the terry weaving loom according to FIG. 7.

FIG. 7 shows the application of the invention to a terry weaving loom with a so-called sley motion control, whereby the overall loom corresponds basically to the terry weaving loom according to FIG. 1, and particularly the guidance of the pile warp thread sheet 15 and the ground warp thread sheet 1 is embodied in the same manner. The warp stop motions 18 and 30 for the pile warp thread sheet 15 and the ground warp thread sheet 1, respectively, are also arranged as shown in FIG. 1. The mechanisms and operations for carrying out the sley motion control have been described above.

FIG. 8 shows an enlarged detail portion VIII of the loom of FIG. 7, and particularly the sley 57, which is pivotably or tiltably arranged about a horizontal axis 52. The sley 57 is pivotally or rockingly driven back-and-forth with a constant stroke about the pivot axis 52 by an eccentric drive 53 that is coupled to and driven by the main shaft of the loom. The reed 11 is tiltably or pivotally supported on the sley 57 about an axis 54 extending parallel to the pivoting axis 52. A further eccentric drive 55 allocated to and connected to the sley 57 pivotally drives the reed 11 about the axis 54 in a controlled manner relative to the sley 57, as shown by the double arrow 56. The eccentric drive 53 controls the back-and-forth motion of the sley 57 for carrying out the partial beat-up of the weft threads at a spacing distance away from the beat-up edge 12. During the partial beat-up, the reed 11 remains rigidly connected to the sley 57, i.e. the reed 11 does not move relatively to the sley 57, but instead only moves with the sley 57. Then, for carrying out the complete group beat-up, the eccentric drive 55 tilts the reed 11 to the required degree in the beat-up direction relative to the sley 57 so that the inserted group of weft threads will be beat-up completely against the beat-up edge 12 of the woven cloth 13. The motions of the eccentric drives 53 and 55 are derived from the main shaft of the loom, with separate control, for example by the machine controller 45.

Throughout the drawings it should be understood that the respective sensor signals are conveyed from the sensors to the machine controller 45, and control signals are conveyed from the controller 45 to the various motors and other drives, respectively by any appropriate signal conductors, for example electrical conductors or fiber optic cables. These signal conductors are merely schematically shown by dashed lines in the drawings, and no detailed discussion thereof is required, because these lines can be embodied in any manner that is conventionally known.

Figure 3A:
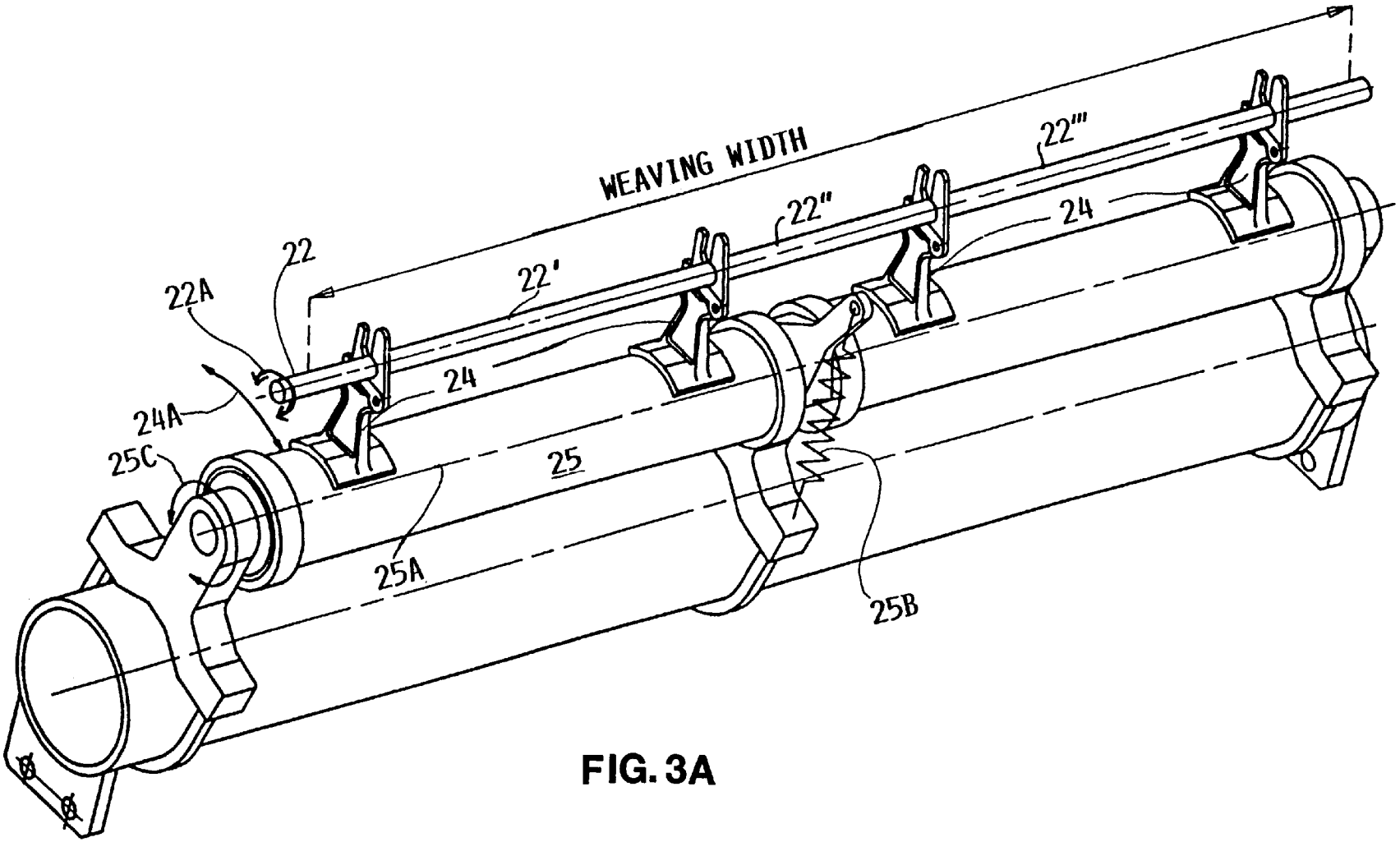
FIG. 3A is a schematic perspective view of a thread deflecting rod that extends across the weaving width and is rotatably supported on a rockable shaft.
Figure 10:
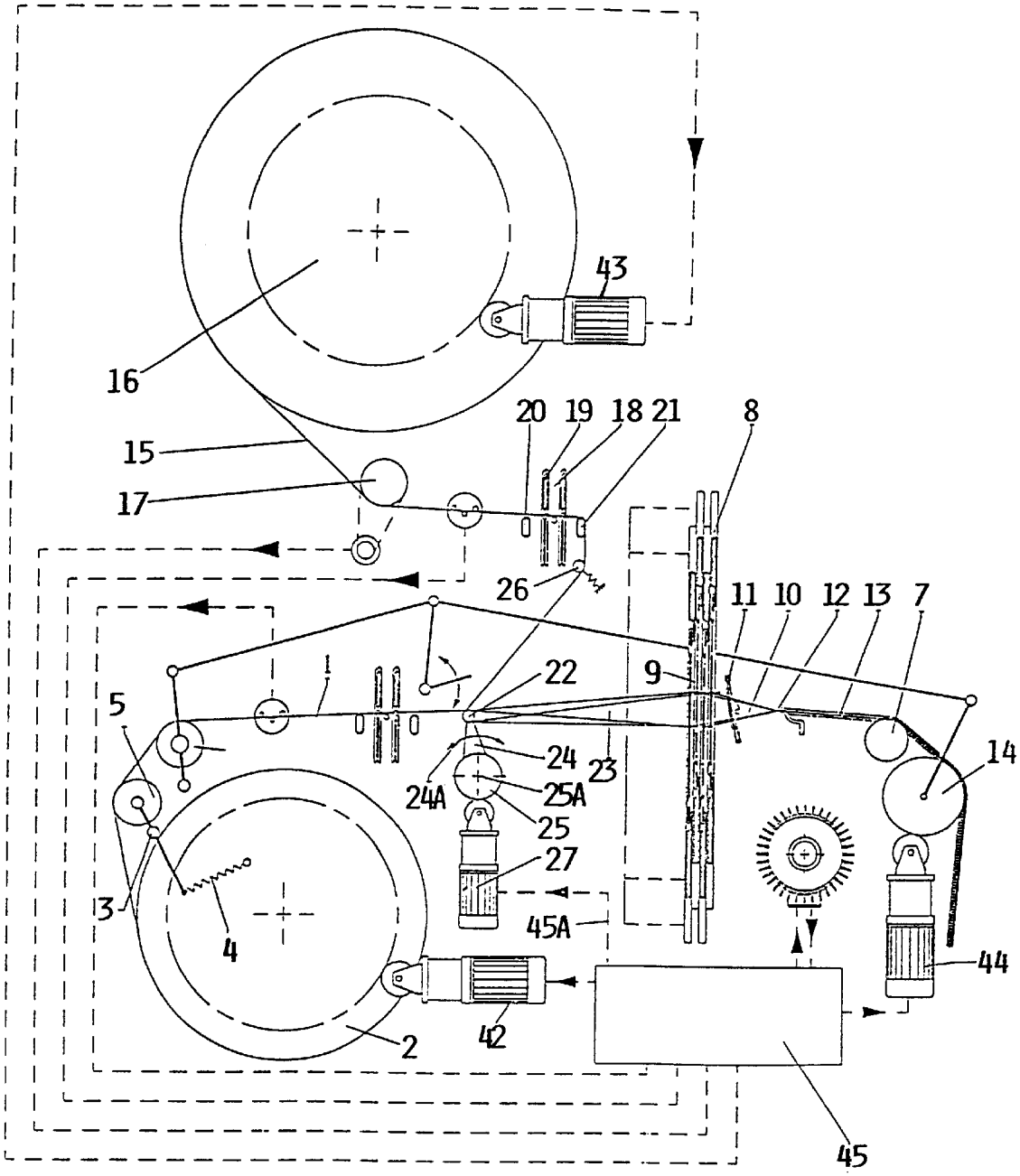
FIG. 10 is a schematic side view similar to FIG. 1, but showing a terry weaving loom according to a first variant of a second embodiment of the invention.
Figure 11:
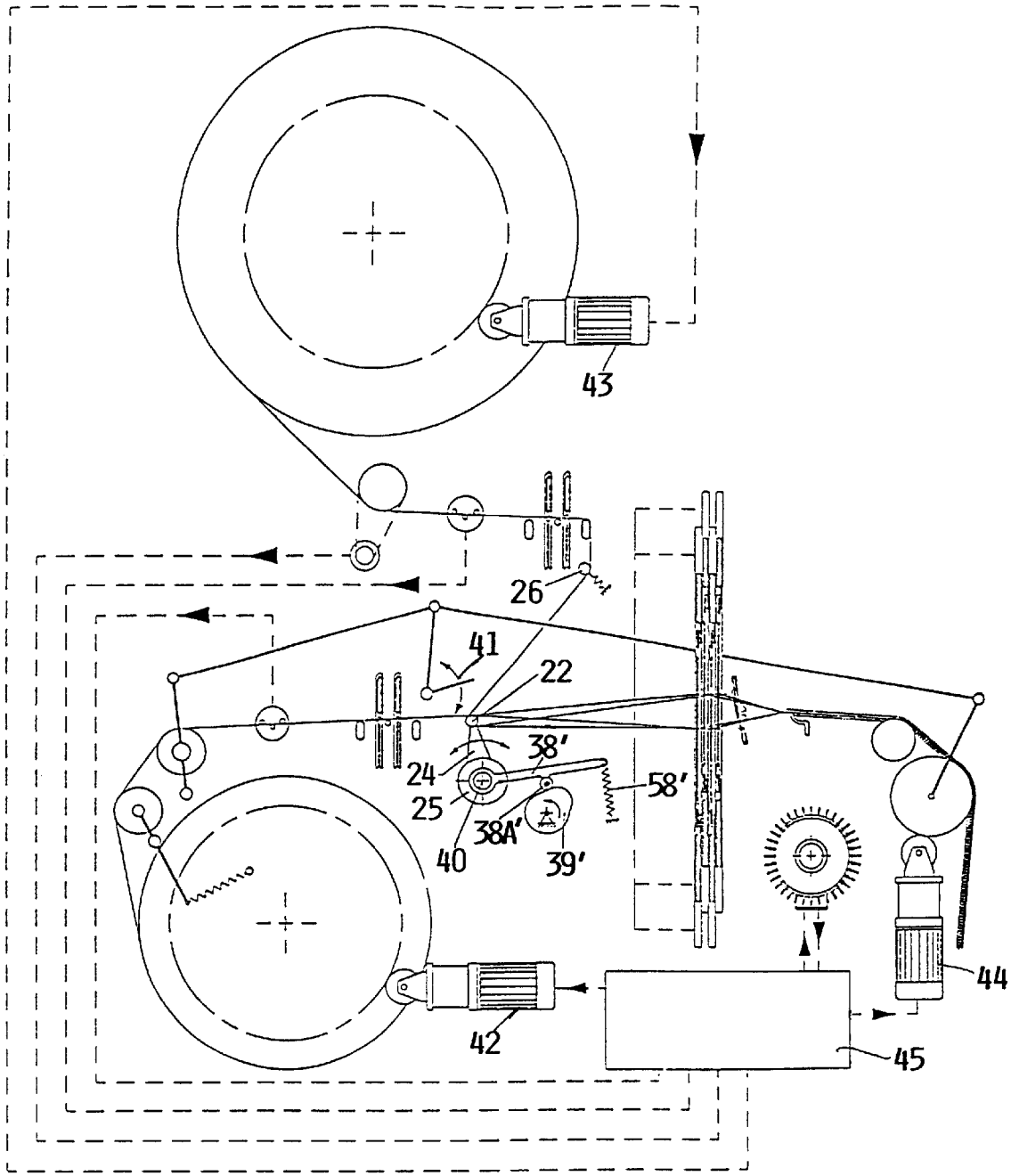
FIG. 11 is a schematic side view similar, to FIG. 10, but showing a terry weaving loom according to a second variant of the second embodiment according to the invention.

FIGS. 10 and 11 show two different variants of mechanisms for actively controlling and driving the pivoting motion of the thread deflecting rod 22 further in connection with FIG. 3A. The overall loom systems shown in FIGS. 10 and 11 generally correspond to that shown in FIG. 1 and described above. Accordingly, the same or corresponding components are labeled with the same reference numbers as discussed above, and a redundant description of those elements and their operation will not be provided here. Instead, the present discussion will focus on the particular special features of the drive arrangements for driving the thread deflecting rod 22.

In the arrangement of FIG. 10 and also schematically partially shown in FIG. 3A, the thread deflecting rod 22 is supported on levers 24 at least at the opposite ends of the deflecting rod 22, but possibly also at additional locations along its length, i.e. along the weaving width. The levers 24 in turn are rigidly connected to the shaft 25 that is rotatably supported to be rotatable or pivotable 25C about the horizontally oriented center axis 25A. The shaft 25 is operatively connected with an electric motor drive 27 (FIG. 10), which is connected for signal transmission via a control signal line 45A with the machine controller 45. The machine controller 45 appropriately operates and controls the electric motor drive 27 according to a freely programmable or adjustable loom operation program, so as to controlledly pivot 24A the thread deflecting rod 22 via the levers 24, for achieving a pile warp thread length compensation for the length variations of the pile warp thread sheet that occur during the weaving process. In other words, the electric motor drive 27 is freely programmably activated during a partial shifting of the woven cloth 13, and particularly after the beat-up of a weft group by the reed 11, in such a manner that the thread deflecting rod 22 pivots in the direction of the double arrow 24A about the center axis 25A, corresponding to the partial shifting of the woven cloth. This pivoting motion of the thread deflecting rod 22 is particularly controlled so that less than ¾ and preferably ⅓ to ½ of the nominal feed advance magnitude of the warp thread length is compensated thereby.

Moreover, the pile warp thread tension of the pile warp thread sheet 15 is held at a relatively low tension level during the partial woven cloth shifting after the weft group beat-up by means of the controlled motion of the thread deflecting rod 22. In this manner, it is achieved that the pile loops formed of the pile warp threads in the woven cloth 13 along the beat-up edge thereof are not again pulled out of the woven cloth 13 in a direction contrary to the weaving direction. After the pile loop formation the deflecting rod is controlledly moved back to its initial position, so that the deflecting rod will be located in its initial or starting position before the renewed or next partial shifting of the woven cloth.

In the example embodiment according to FIG. 11 (with basic components again schematically partially shown in FIG. 3A), the thread deflecting rod 22 is once again connected to the pivotable shaft 25 by levers 24. Instead of the electric motor drive 27, the variant of FIG. 11 uses a cam and lever drive arrangement for controlledly pivoting or rocking the thread deflecting rod 22, as follows. A one armed lever 38' (FIG. 11) is secured against rotation to the shaft 25, i.e. so that a tilting of the lever 38' causes a pivoting 25C (FIG. 3A) of the shaft 25. A tension spring 58' is connected rigidly to a machine frame of the loom and to the free end of the lever arm 38'. Between its free end and its opposite end which is rigidly connected to the shaft 25, the lever arm 38' carries a following roller 38A' which rides in a following manner on the outer perimeter of a rotationally driven cam disk 39'. The cam disk 39' has an appropriate outer contour in order to impose on the lever arm 38' the appropriate tilting motion so as to drive the shaft 25 with a pivoting or rocking motion, to achieve the same controlled motion of the deflecting rod 22 as has been described above in connection with FIG. 10. The rotational drive of the cam disk 39' itself can be derived from the main drive shaft of the loom, or may be provided by a simple and economical electric motor drive that is independent of the main loom drive and does not require complex and costly control electronics.

Alternatively or additionally to the thread deflecting rod 22, as illustrated in FIGS. 10 and 11, a spring-loaded compensating shaft 26 can be arranged along the pile warp thread path between the rod 21 of the pile warp stop motion 18 and the deflecting rod 22, whereby the pile warp threads are at least partially looped around and deflected over this additional compensating shaft or roller 26. Thereby, the compensating shaft or roller 26 provides an additional compensation of the varying length of the pile warp threads that arises during the weaving process. While this compensating shaft or roller 26 merely achieves a passive spring-loaded compensation, the thread deflecting rod 22 achieves a controlled active compensation as described above, so that these two different compensating means complement each other. By providing a controlled influence and compensation an the pile warp thread length and pile warp thread tension, it has become possible to achieve a unique and very consistent pile loop formation in the woven terry cloth, which gives the finished terry cloth an excellent visual appearance.

When a plane herein is referred to as being "substantially horizontal" or "substantially vertical", it should be understood as including plane orientations that are within +/−10° from horizontal or vertical, respectively. All references herein to "upstream" and "downstream" are indications of direction relative to the ordinary net forward thread running direction during weaving.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. In a terry weaving loom system including a first thread supply arrangement, a plurality of ground warp threads supplied from said first thread supply arrangement and forming a ground warp thread sheet, a second thread supply arrangement, a plurality of pile warp threads supplied from said second thread supply arrangement and forming a pile warp thread sheet, a shed forming device which receives said ground warp threads and said pile warp threads extending therethrough and is adapted to form a respective open shed of said ground warp threads and said pile warp threads including a back shed on an upstream side of said shed forming device toward said first and second thread supply arrangements and a front shed on a downstream side of said shed forming device opposite said upstream side, a weft insertion device adapted to insert a weft thread into said front shed of said open shed, and a weft beating device adapted to beat-up the weft thread while forming terry pile loops of said pile warp threads, an improvement wherein said pile warp thread sheet intersects with and crosses through said ground warp thread sheet at a thread crossing location between said first thread supply arrangement and said back shed, and comprising a pile warp thread reserve and compensating device arranged on a pile warp thread path followed by said pile warp threads between said second thread supply arrangement and said thread crossing location, with said pile warp thread sheet guided and deflected over said pile warp thread reserve and compensating device which is adapted to form a reserve length of said pile warp threads and to compensate length variations of said pile warp threads during the forming of the terry pile loops or during the change of shed.

2. The improvement in the terry weaving loom system according to claim 1, wherein said pile warp thread reserve and compensating device comprises a spring elastically yielding thread length compensating element around which said pile warp threads are partially looped and deflected.

3. The improvement in the terry weaving loom system according to claim 2, wherein said thread length compensating element comprises a thread deflecting shaft that is spring-elastically yieldably supported.

4. The improvement in the terry weaving loom system according to claim 2, wherein said thread length compensating element comprises a thread deflecting metal sheet or plate that is elastically flexible or spring-elastically yieldably supported.

5. The improvement in the terry weaving loom system according to claim 1, wherein said pile warp thread reserve and compensating device is a passive elastically yielding device adapted to yield passively in response to tension variations in said pile warp threads, and further comprising a thread deflection arrangement including a thread deflecting element arranged on said pile warp thread path between said pile warp. thread reserve and compensating device and said back shed with said pile warp threads deflected around said thread deflecting element, and a drive mechanism connected to said thread deflecting element and adapted to positively actively move said thread deflecting element for achieving an active controlled compensation of said length variations of said pile warp threads.

6. The improvement in the terry weaving loom system according to claim 1, further comprising a thread deflecting element arranged on said pile warp thread path between said pile warp thread reserve and compensating device and said back shed, on a side of said ground warp thread sheet opposite said second thread supply arrangement, wherein said pile warp threads are deflected around said thread deflecting element.

7. The improvement in the terry weaving loom system according to claim 6, wherein said thread deflecting element comprises a thread deflecting rod around which said pile warp threads are deflected.

8. The improvement in the terry weaving loom system according to claim 7, wherein said thread deflecting rod is a jointed rod, which is supported respectively at plural locations along a length of said rod extending over a weaving width of said loom system.

9. The improvement in the terry weaving loom system according to claim 7, wherein said thread deflecting rod is rotatably supported.

10. The improvement in the terry weaving loom system according to claim 7, wherein said thread deflecting rod is elastically yieldably supported.

11. The improvement in the terry weaving loom system according to claim 7, wherein said thread deflecting rod is adjustably supported.

12. The improvement in the terry weaving loom system according to claim 1, wherein said pile warp thread sheet intersects with and crosses through said ground warp thread sheet at an obtuse crossing angle formed about said thread crossing location between said pile warp thread sheet and said ground warp thread sheet extending upstream from said thread crossing location.

13. The improvement in the terry weaving loom system according to claim 1, wherein said pile warp thread sheet intersects with and crosses through said ground warp thread sheet at an acute crossing angle formed about said thread crossing location between said pile warp thread sheet and said ground warp thread sheet extending upstream from said thread crossing location.

14. The improvement in the terry weaving loom system according to claim 1, further comprising a first warp stop motion arranged with said ground warp threads extending therethrough, and a second warp stop motion that is separate from said first warp stop motion and is arranged with said pile warp threads extending therethrough, wherein said first and second warp stop motions are each respectively freely accessible from at least one respective side of said loom system.

15. The improvement in the terry weaving loom system according to claim 14, wherein said first and second warp stop motions are respectively separately arranged on two different planes that are vertically spaced apart from one another.

16. The improvement in the terry weaving loom system according to claim 14, wherein said pile warp thread sheet extends through said second warp stop motion along a substantially horizontal plane.

17. In a terry weaving loom system including a first thread supply arrangement, a plurality of ground warp threads supplied from said first thread supply arrangement and forming a ground warp thread sheet, a second thread supply arrangement, a plurality of pile warp threads supplied from said second thread supply arrangement and forming a pile warp thread sheet, a shed forming device which receives said ground warp threads and said pile warp threads extending therethrough and is adapted to form a respective open shed of said ground warp threads and said pile warp threads including a back shed on an upstream side of said shed forming device toward said first and second thread supply arrangements and a front shed on a downstream side of said shed forming device opposite said upstream side, a weft insertion device adapted to insert a weft thread into said front shed of said open shed, and a weft beating device adapted to beat-up the weft thread while forming terry pile loops of said pile warp threads, an improvement wherein said pile warp thread sheet intersects with and crosses through said ground warp thread sheet at a thread crossing location between said first thread supply arrangement and said back shed, and comprising a thread deflecting arrangement that includes a thread deflecting rod extending along a weaving width of said loom system on a side of said ground warp thread sheet opposite said second thread supply arrangement and having said pile warp threads deflected thereon, a shaft that extends along and is pivotable about a horizontal axis, support levers fixedly connected to said shaft and supporting said thread deflecting rod so that said thread deflecting rod rocks pivotally along with a pivoting of said shaft about said axis, and a pivot drive connected to said shaft and adapted to controlledly drive a pivoting motion of said shaft about said axis.

18. The improvement in the terry weaving loom system according to claim 17, wherein said pivot drive comprises a reversible electric motor.

19. The improvement in the terry weaving loom system according to claim, 17, wherein said pivot drive comprises a rotatable cam disk.

20. The improvement in the terry weaving loom system according to claim 19, wherein said pivot drive further comprises a cam follower linkage operatively connected between said cam disk and said shaft.

* * * * *

UNITED STATES PATENT AND TRADEMARK OFFICE

CERTIFICATE OF CORRECTION

PATENT NO. : 6,390,144 B2
DATED : May 21, 2002
INVENTOR(S) : Wahhoud et al.

It is certified that error appears in the above-identified patent and that said Letters Patent is hereby corrected as shown below:

Title page,
Item [73], Assignee,
Line 2, replace "GmbH" by -- mbH --;

Column 1,
Line 16, before "filed", delete -- Ser. No. 09/855,150 --;
Line 19, replace "1. Field of the Invention" by -- FIELD OF THE INVENTION --;
Line 25, replace "b2.Background Information" by -- BACKGROUND INFORMATION --;

Column 6.
Line 9, after "low", insert -- , --;
Line 20, after "from", replace "800" by -- 80° --;
Line 41, replace "user friendly" by -- user-friendly --;

Column 8,
Line 15, replace "letting out" by -- letting-out --;
Line 21, after "similar", delete -- , --;

Column 9,
Line 6, after "sley", insert -- 57 --;
Line 15, replace "group wise" by -- group-wise --;
Line 27, before "roller", replace "deflects" by -- deflecting --;
Line 35, replace "Springer Verlag" by -- Springer-Verlag --;
Line 36, after "warp", delete -- , --;

Column 10,
Line 17, after "be", replace "non rotatably" by -- non-rotatably --;
Line 54, before "metal", replace "spring character" by -- spring-character --;

UNITED STATES PATENT AND TRADEMARK OFFICE

CERTIFICATE OF CORRECTION

PATENT NO. : 6,390,144 B2
DATED : May 21, 2002
INVENTOR(S) : Wahhoud et al.

It is certified that error appears in the above-identified patent and that said Letters Patent is hereby corrected as shown below:

Column 11,
Line 34, after "this", replace "machines" by -- machine --;
Line 38, after "a", replace "dash dotted" by -- dash-dotted --;

Column 12,
Line 12, after "The", replace "springs-loaded" by -- spring-loaded --;
Line 18, after "reed", replace "it" by -- 11 --;
Line 19, before "beat-up", replace "group wise" by -- group-wise --;

Column 14,
Line 46, after "beam", replace "6' " by -- 6 --;
Line 55, after "pivoting", delete -- , --;
Line 61, after "time", replace "up-wardly" by -- upwardly --;

Column 17,
Line 3, before "the", replace "an" by -- on --;
Line 56, after "a", replace "spring elastically" by -- spring-elastically --.

Signed and Sealed this

Twenty-ninth Day of October, 2002

*Attest:*

*Attesting Officer*

JAMES E. ROGAN
*Director of the United States Patent and Trademark Office*